US006164043A

United States Patent [19]

Miller et al.

[11] Patent Number: 6,164,043

[45] Date of Patent: Dec. 26, 2000

[54] METHOD AND APPARATUS FOR OPENING AN ENVELOPE IN AN INSERTING MACHINE

[75] Inventors: John Miller, Shelton, Conn.; William B. Riley, Alexandria, Va.

[73] Assignee: Pitney Bowes Inc., Stamford, Conn.

[21] Appl. No.: 09/407,338

[22] Filed: Sep. 29, 1999

[51] Int. Cl.[7] ..... B65B 11/48

[52] U.S. Cl. ..... 53/460; 53/381.6

[58] Field of Search ..... 53/381.1, 381.3, 53/381.6, 386.1, 460; 493/479, 478

[56] References Cited

U.S. PATENT DOCUMENTS

| | | | |
|---|---|---|---|
| 3,640,523 | 2/1972 | Beck | 271/28 |
| 4,035,988 | 7/1977 | Daniels . | |
| 4,718,832 | 1/1988 | Takahashi | 417/417 |
| 4,835,941 | 6/1989 | Torii et al. . | |
| 4,921,388 | 5/1990 | Nelson . | |
| 5,042,521 | 8/1991 | Shiomi | 137/118 |
| 5,052,168 | 10/1991 | DeWitt et al. | 53/492 |
| 5,054,274 | 10/1991 | Tanaka . | |
| 5,061,146 | 10/1991 | Nelson . | |
| 5,581,972 | 12/1996 | Antonelli . | |
| 5,632,605 | 5/1997 | Bez | 417/266 |

*Primary Examiner*—Eugene Kim
*Attorney, Agent, or Firm*—Steven J. Shapiro; Michael E. Melton

[57] ABSTRACT

A method and an apparatus for opening an envelope for document insertion in a document inserting system. The apparatus includes: an air chamber having a first end and an opposing second end and an inlet in the first end; a piston movably located in the air chamber for dividing the air chamber into a first chamber near the first end and a second chamber near the second end; a suction cup operatively connect to the air inlet to pick up the throat of an envelope; a spring operatively connect with the piston; and a cam operable at a first position to compress the spring and to keep the piston near the first end, and at the second position to release the spring which urges the piston to move away from the first end and expand the first chamber, thereby creating a suction force for the suction cup. Accordingly, the method of opening an envelope includes the steps of: 1) keeping the cam at the first position; 2) causing the suction cup press against the envelope throat; 3) cause the cam to operate at the second position to release the spring, creating a suction force for the suction cup; 5) moving the suction cup together with the throat of the envelope to spread open the envelope; and 6) after the document is inserted past the throat entrance, recompressing the spring by causing the cam to operate at the first position, as in step 1.

14 Claims, 3 Drawing Sheets

METHOD AND APPARATUS FOR OPENING AN ENVELOPE IN AN INSERTING MACHINE

TECHNICAL FIELD

The present invention relates generally to a document inserting machine and, more specifically, an envelope opening apparatus in the inserting machine.

BACKGROUND OF THE INVENTION

In an inserting machine for mass mailing, there is a gathering section where enclosure material is gathered before it is inserted into an envelope. This gathering section is sometimes referred to as a chassis subsystem, which includes a gathering transport with pusher fingers rigidly attached to a conveyor belt and a plurality of enclosure feeders mounted above the transport. If the enclosure material contains many documents, these documents must be separately fed from different enclosure feeders. After all the released documents are gathered, they are put into a stack to be inserted into an envelope in an inserting station. Envelopes are separately fed to the inserting station one at a time, and each envelope is placed on a platform facing down with its flap flipped back all the way. Typically, mechanical fingers or vacuum suction devices are used to keep the front side of the envelope on the platform while the throat on the back side of the envelope is pulled upward to open the envelope. The stack of enclosure material is than automatically inserted into the opened envelope.

In the past, vacuum suction has been used to open envelopes as a precursor to material insertions. For example, U.S. Pat. No. 5,052,168 (DeWitt el al.) discloses a method and an apparatus to spread open an envelope where two suction cups are placed on the opposing faces of the envelope. An air flow is drawn through two respective suction arms to produce a negative air pressure in order to spread out the envelope faces. A vacuum pump, along with a plurality of bleed valves, release valves and dump valves is used to produce the necessary suction force. Like other similar designs, the method disclosed by DeWitt et al. uses a constantly running vacuum pump to draw the air flow in order to open and maintain the open position of envelopes for either material insertion or extraction. The various valves in the vacuum manifold are opened or closed whenever vacuum is required for the suction cups to pick up the faces of the envelope. Typically, a large A.C. vacuum pump is required to produce the necessary suction force. The disadvantages of using such a vacuum pump in an inserting machine include the following:

1) a large housing is required to accommodate such a vacuum pump;
2) energy is wasteful because the power consumption of a large pump is high;
3) energy is wasteful because the pump is kept running even when it is not used to open an envelope; and
4) the noise levels generated by the constantly running pump are high.

It is advantageous to provide a method and an apparatus for opening envelopes in a document insertion and extraction station, wherein the apparatus is activated only during the period that it is needed to open an envelope and the apparatus permits the use of a small motor and eliminates the need for external valving to control the vacuum.

SUMMARY OF THE INVENTION

The present invention provides a method and an apparatus to spread open an envelope in a document insertion machine for inserting documents into the envelope. The envelope has a front side and a back side with a throat, wherein the front side is kept in place with a holding device.

The apparatus for opening the envelope by picking up and lifting the throat with a suction force in order to separate the throat on the back side of the envelope from the front side of the envelope, wherein the suction force is resulted from an air pressure lower than the atmospheric pressure, the apparatus includes: a housing having a first end and an opposing second end for defining an air chamber therein; a piston, movably located within the air chamber, for dividing the air chamber into a first chamber near the first end and a second chamber near the second end, wherein the first chamber has an inlet to allow air to come in and out of the first chamber; a suction cup operatively connected to the inlet; a cam operable at a first position for keeping the piston near the first end and a second position for allowing the piston to move away from the first end; and a spring which is compressed when the cam is operated in the first position and released when the cam is operated in the second position, wherein the spring, when released, provides a biasing force to urge the piston to move away from the first end of the housing thereby drawing air into the first chamber via the inlet and the suction cup, creating the suction force for the suction cup to pick up the throat.

With the apparatus as described above, the method for opening an envelope in an inserting machine, according to the present invention, includes the following steps: 1) compressing the spring by the cam; 2) positioning the envelope so that its throat is located adjacent the suction cup; 3) causing the suction cup to press against the envelope throat; 4) rotating the cam to release the spring, causing the piston to move away from the inlet in order to generate a low pressure in the air chamber thereby creating a suction force for the suction cup; 5) moving the suction cup together with the throat of the envelope to separate the throat on the back side of the envelope from the front side of the envelope; and 6) after the document is inserted past the throat entrance, recompressing the spring by rotating the cam to the initial position, as in step 1.

The method and apparatus for opening envelopes, according to the present invention, will become apparent upon reading the descriptions taken in conjunction with FIG. 1 to FIG. 2D.

DETAILED DESCRIPTION

Figure 1:
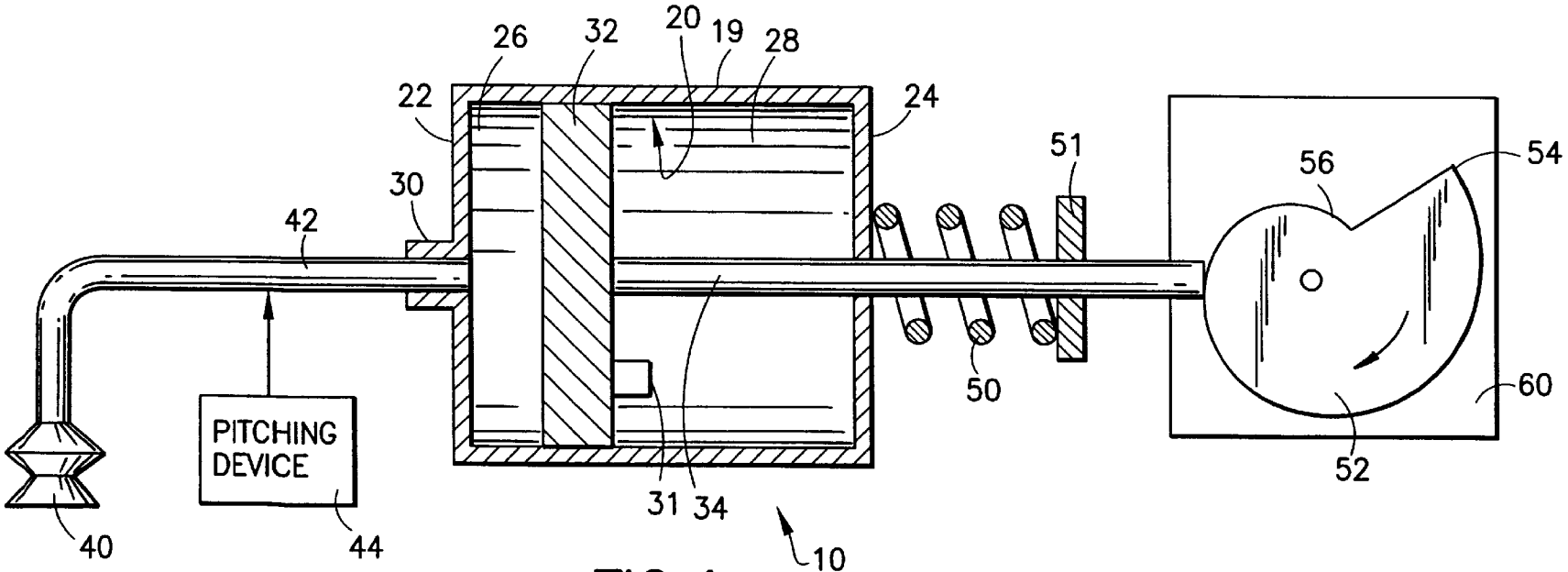
FIG. 1 illustrates the envelope opening apparatus of the present invention.

FIG. 1 illustrates an apparatus 10 which can specifically be used for opening envelopes in an inserting station and can be used generally for picking up and moving objects from one position to another. In FIG. 1, the apparatus 10 includes a suction cup 40 and a housing 19 defining an air chamber 20 therein which is sized to provide the necessary air volume to the suction cup 40 to complete one envelope opening cycle as discussed in more detail below. A piston 32, movably located inside the air chamber 20, is spring-actuated to draw air into the air chamber 20 through an air inlet 30. As shown, suction cup 40 is connected, through a tubing 42, to air inlet 30 which is located at a first end 22 of the housing 19. Piston 32 is attached to a shaft 34 extending out of the housing 19 through a second end 24 of the housing 19, opposite to the first end 22. A spring 50 is used to move piston 32 away from air inlet 30. The spring 50, located between the second end 24 of the housing 19 and a flange 51 which is fixed mounted on the shaft 34, can be compressed to provide a biasing force to the piston 32, urging the piston 32 to move toward the second end 24 of the housing 19. A cam 52, driven by a motor 60, preferably a high resolution motor such as a stepper motor, is used to compress spring 50 upon demand. A pitching device 44, which can be made of another motor driven cam (not shown), is used to pitch the suction cup up and down, independently of or together with the housing 19. Effectively, piston 32 divides the air chamber 20 into a first chamber 26 adjacent to the first end 22 and a second chamber 28 adjacent the second end 24. Preferably, a relief valve 31 located on the piston 34 is used to provide a one-way conduit to allow air to flow from the first chamber 26 to the second chamber 28 when the air pressure in the first chamber 26 is too much higher than the air pressure in the second chamber 28 in order to prevent excessively positive pressure buildup in chamber 26. A positive pressure is defined as an air pressure higher than the atmospheric pressure. A negative pressure or low air pressure is defined as an air pressure lower than the atmospheric pressure. When spring 50 is compressed by cam 52 to keep piston 32 near the first end 22 of the housing 19, the volume of the first chamber 26 is, preferably, small or substantially equal to zero. After suction cup 40 has been firmly pressed against an item to be picked up by pitching device 44 (as shown in FIG. 2B), cam 52 is rotated by motor 60 just enough to release spring 50. Consequently, piston 32 is moved by the spring, 50 toward the second end 24 of housing 19 thereby expanding first chamber 26 and drawing air from inlet 30. The drawing of air from inlet 30 into the expanded first chamber 26 creates a low air pressure in suction cup 40 sealing suction cup 40 against the item to be picked up.

It should be noted that cam 52 has different radii to define its outer rim, as shown in FIG. 1. At a point denoted by reference numeral 54, the radius of the cam 52 is greatest. When cam 52 is rotated such that shaft 34 is in contact with the cam 52 at point 54, spring 50 is in a compressed stage and piston 32 is positioned very near first end 22. At the point denoted by reference numeral 56, the radius of the cam 52 is smallest. When the cam 52 is rotated clockwise, as illustrated, by motor 60 so that shaft 34 contacts cam 52 at point 56, spring 50 is released from its compressed state thereby forcing piston 32 away from first end 22 to expand first chamber 26.

In preparation for picking up the next item, cam 52 is further rotated in the clockwise direction to bring point 54 into contact with shaft 34 thereby recompressing spring 50 into a charged position.

It should also be noted that it is possible to replace piston 32 with a thin diaphragm or a bellows that would act in a similar manner to the piston 32.

Figure 2A:
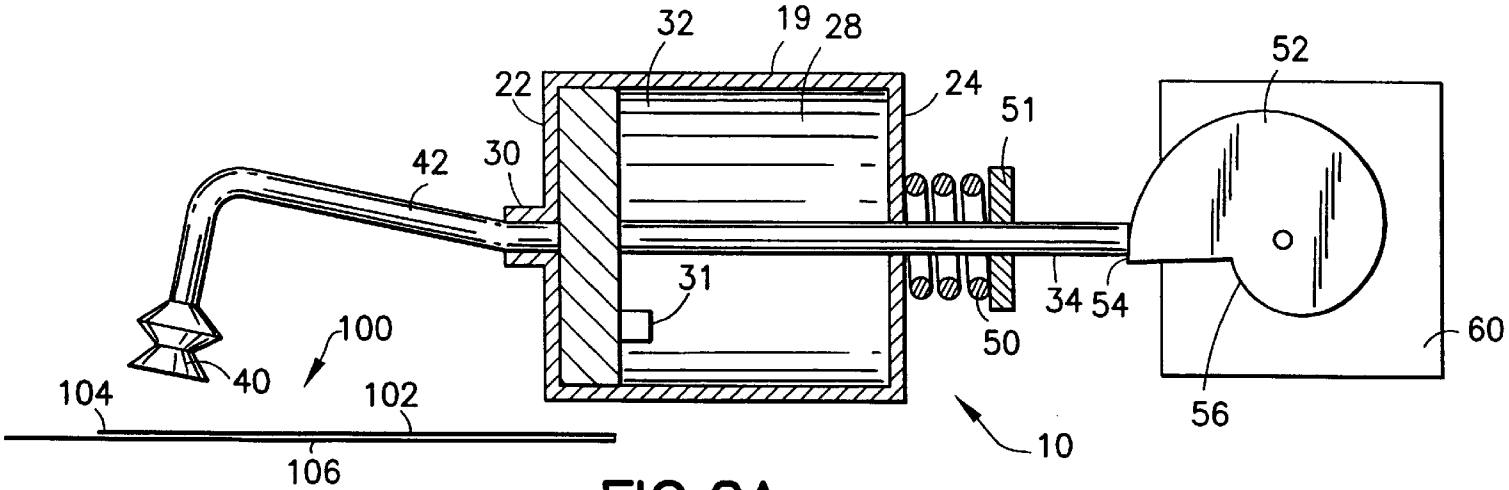
FIGS. 2A through 2D illustrate the different steps in an envelope opening cycle using the apparatus of the present invention.
Figure 2B:
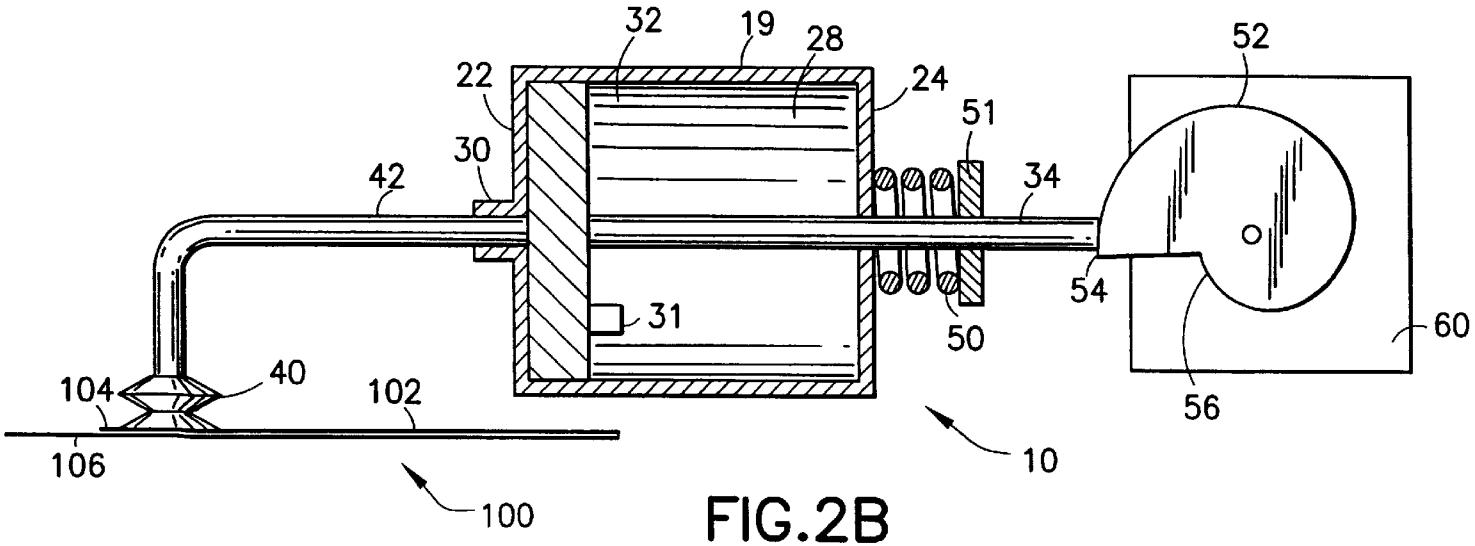

FIGS. 2A–2D illustrate the different steps in an envelope opening cycle using the apparatus 10 of the present invention. As shown in FIG. 2A, spring 50 is initially compressed by the cam 52 as the shaft 34 is in contact with the cam 52 at point 54. Piston 32, preferably, is pushed to the first end 22 of the housing 19. At this stage, suction cup 40 is in the raised position so as to allow an envelope 100 to be placed under the apparatus 10. In FIG. 2A, there is shown an envelope 100 having its front side 106 facing downward and its back side 102 facing the apparatus 10.

Figure 2C:
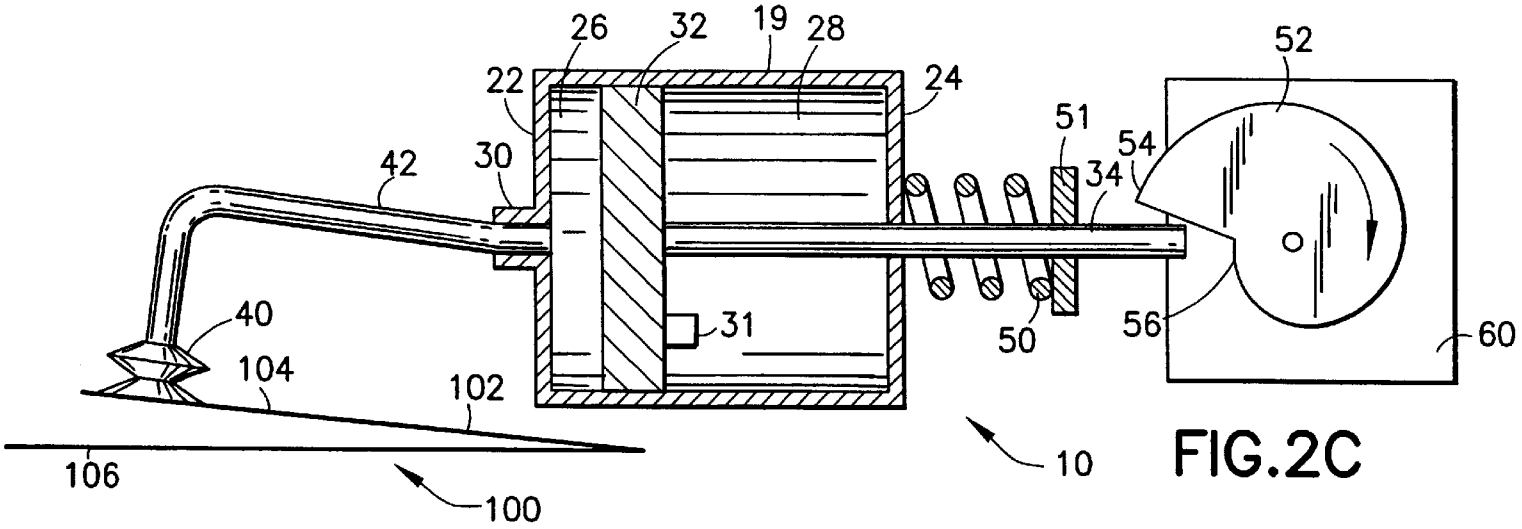
Figure 2D:
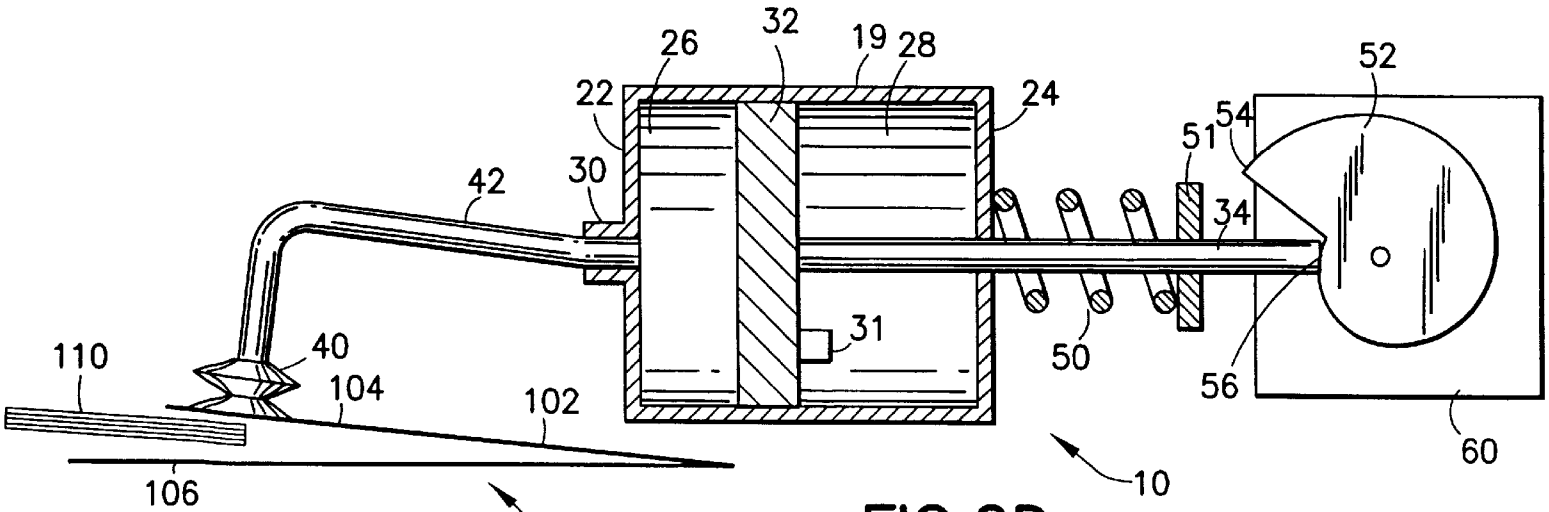

After envelope 100 has been positioned so that its throat 104 on the back side 102 is under suction cup 40, the suction cup 40 is pitched down by a pitching device (see FIG. 1) to press against the envelope 100, as shown in FIG. 2B. At this time, the cam 52 is rotated by the motor 60 just enough to release the spring 50. The spring 50 pushes the piston 32 via the flange 51 toward the second end 24 of the housing 19, generating a low air pressure in the suction cup 40. The suction cup 40 is then pitched up by the pitching device, separating the back side 102 of the envelope from the front side 106, as shown in FIG. 2C. It should be noted that, in a typical envelope inserting station, the front side 106 is kept in place by a mechanical device or a suction device which is not part of the present invention and, therefore, is not shown in the drawings. As envelope 100 is now spread open, enclosure material 110 can be inserted into envelope 100.

After the leading edge of the enclosure material 110 has passed the throat entrance, it is not necessary to keep envelope 100 spread open. At this time, the cam 52 is rotated in the clockwise direction forcing the piston 32 to move back toward the first end 22 of the housing 19. The forward movement of the piston 32 toward the first end 22 of the housing 19 pushes air out of the first air chamber 26 and the suction cup 40. This air flow helps separate the envelope 100 from the suction cup 40 so that the stuffed envelope can be moved away from the apparatus 10. The spring 50 is again compressed in preparation for the next envelope opening cycle.

It should be noted that the method of envelope opening, according to the present invention, has been described as having one suction cup attached to one air chamber. It is, however, possible that two or more suction cups and two or more air chambers be needed to pick up an item, depending on the application and the weight and size of the item. Furthermore, the apparatus as described above can be used to spread open an envelope for material extraction as well as insertion.

Although the invention has been described with respect to a preferred version and embodiment thereof, it will be understood by those skilled in the art that the foregoing and various other changes, omissions and deviations in the form and detail thereof may be made without departing from the spirit and scope of this invention.

What is claimed is:

1. In a document insertion machine for inserting documents into envelopes, each envelope having a front side and a back side with a throat, wherein the front side is kept in place with a holding device, an apparatus for picking up the throat on the back side by a suction force resulting from a low air pressure which is lower than an atmospheric pressure so as to separate the throat on the back side of the envelope from the front side of the envelope, said apparatus comprising:

a housing having a first end and a second end opposite to the first end to define an air chamber therein;

a chamber divider, movably located within the air chamber, for dividing the air chamber into a first chamber near the first end and a second chamber near the second end; the first chamber having an inlet to allow air to come in and out of the first chamber;

a suction device operatively connected to the inlet;

a restraining mechanism operable at a first position for keeping the chamber divider near the first end, and at a second position for causing the chamber divider to move away from the first end, expanding the first chamber and drawing air into the first chamber via the inlet and the suction device, thereby creating the suction force for the suction device to pick up the throat.

2. The apparatus of claim 1, wherein the chamber divider comprises a piston having a shaft and a flange, wherein the shaft extends out of the second end of the housing to be engaged with the restraining mechanism, and the flanged is fixedly mounted on the shaft away from the second end of the housing; and wherein the restraining mechanism comprises a spring located and compressed between the flanged and the second end of the housing to provide a biasing force to the piston, urging the piston to move away from the first end of the housing when the restraining mechanism is operated at the second position.

3. The apparatus of claim 2, wherein the restraining mechanism comprises a cam mechanically engaged with the shaft, the cam having at least a first radius to define the first position of the restraining mechanism and a second radius smaller than the first radius to define the second position of the restraining mechanism.

4. The apparatus of claim 3, wherein the restraining mechanism further comprises means for rotating the cam to cause the restraining mechanism to operate at the first position or the second position.

5. The apparatus of claim 1, wherein the chamber divider comprises a diaphragm.

6. The apparatus of claim 1, wherein the chamber divider comprises a bellows.

7. The apparatus of claim 1 further comprising a pitching device at a first pitching position for moving the suction device into contact with the envelope and at a second pitching position for moving the suction device away from the envelope.

8. The apparatus of claim 1, wherein the suction device comprises a suction cup.

9. The apparatus of claim 1 further comprising a relief valve in the air chamber to prevent excessive positive pressure buildup in the first air chamber, wherein the positive pressure is resulted from an air pressure higher than an atmospheric pressure.

10. An apparatus for opening an envelope for document insertion in an envelope inserting machine wherein the envelope has a front side and a back side with a throat, the apparatus comprising:

a housing having a first end and an opposing second end to define an air chamber therein;

a piston movably located in the air chamber to divide the air chamber into a first chamber near the first end and a second chamber near the second end, wherein the piston has a shaft extending out of the second end of the housing and a flange fixedly mounted on the shaft away from the second end;

an inlet connected to the first chamber to allow air to come in and out of the first chamber;

a suction cup operatively connected to the inlet for picking up the throat;

a cam operable at a first position to keep the piston near the first end and a second position to allow the piston to move away from the first end to expand the first air chamber and draw air into the first chamber out of the suction cup through the inlet, thereby creating in the suction cup an air pressure lower than an atmospheric pressure; and a spring compressed between the flange and the air chamber to urge the piston to move away from the first end when the cam is operated at the second position.

11. The apparatus of claim 10 further comprising means for causing the suction cup to press against the throat of the envelope and to move away from the front side of the envelope.

12. In a document inserting machine for inserting documents into envelopes, each envelope having a front side and a back side with a throat, wherein the front side of the envelope is kept in place by a holding device and wherein a suction cup is used to pick up the throat of the envelope;

a housing having a first end and an opposing second end to define an air chamber;

a piston movably located inside the air chamber to divide the air chamber into a first chamber near the first end and a second chamber near the second end, wherein the piston has a shaft extending out of the second end of the housing and a flange fixedly mounted on the shaft away from the second end of the housing, wherein the first chamber is operatively connected to the suction cup;

a cam, which is mechanically engaged with the shaft, operable at a first position to keep the piston near the first end and at a second position to allow the piston to move away from the first end to expand the first chamber and draw air from the suction cup, thereby creating in the suction cup an air pressure lower than an atmospheric pressure; and a spring located between the flange and the second end of the housing wherein the spring is in a compressed state when the cam is operated at the first position and the spring is released when the cam is operated at the second position, wherein the spring urges the piston to move away from the first end when the spring is released;

a method of opening an envelope comprising the steps of:

1) keeping the cam at the first position;

2) moving the suction cup into contact with the throat of the envelope;

3) causing the cam to operate at the second position in order to move the piston away from the first end thereby creating a suction force for the suction cup; and 4) moving the suction cup together with the throat on the back side of the envelope away from the front side of the envelope so as to separate the throat on the back side of the envelope from the front side of the envelope, allowing document to be inserted into the envelope through the throat.

13. The method of claim 12 further comprising the step of causing the cam to operate at the first position after the document has been inserted into the envelope to move the piston toward the first end and move air toward the suction cup in order to release the throat of the envelope from the suction cup.

14. In a document inserting machine for inserting documents into envelopes, each envelope having a front side and a back side with a throat, wherein the front side of the envelope is kept in place by a holding device and wherein a suction device is used to pick up the throat of the envelope;

a housing having a first end and an opposing second end to define an air chamber;

a piston movably located inside the air chamber to divide the air chamber into a first chamber near the first end and a second chamber near the second end, wherein the piston has a shaft extending out of the second end of the housing and a flange fixedly mounted on the shaft away from the second end of the housing, wherein the first chamber is operatively connected to the suction device; and a restraining means, at a first position, for keeping the piston near the first end and, at a second position, for causing the piston to move away from the first end to expand the first chamber and draw air from the suction device, thereby creating in the suction device an air pressure lower than an atmospheric pressure;

a method of opening an envelope comprising the steps of:

1) keeping the restraining means at the first position;

2) moving the suction device into contact with the throat of the envelope;

3) causing the restraining means to operate at the second position to create a suction force for the suction device; and 4) moving the suction device together with the throat on the back side of the envelope away from the front side of the envelope so as to separate the throat on the back side of the envelope from the front side of the envelope, allowing document to be inserted into the envelope through the throat.

* * * * *